US009587453B2

(12) United States Patent
Wesson, Jr. et al.

(10) Patent No.: US 9,587,453 B2
(45) Date of Patent: Mar. 7, 2017

(54) HYDRAULIC JAR AND A FLOW CONTROL DEVICE USABLE IN THE HYDRAULIC JAR

(71) Applicant: Access Downhole LP, Norman, OK (US)

(72) Inventors: Harold Robinson Wesson, Jr., Norman, OK (US); Shea Keller Wesson, Norman, OK (US)

(73) Assignee: Access Downhole LP, Norman, OK (US)

( * ) Notice: Subject to any disclaimer, the term of this patent is extended or adjusted under 35 U.S.C. 154(b) by 382 days.

(21) Appl. No.: 14/223,302

(22) Filed: Mar. 24, 2014

(65) Prior Publication Data

US 2015/0267494 A1 Sep. 24, 2015

(51) Int. Cl.
*E21B 31/113* (2006.01)

(52) U.S. Cl.
CPC ..... *E21B 31/1135* (2013.01); *E21B 31/113* (2013.01)

(58) Field of Classification Search
CPC ..... E21B 31/113; E21B 34/14
See application file for complete search history.

(56) References Cited

U.S. PATENT DOCUMENTS 4,109,736 A 8/1978 Webb et al.
4,456,081 A 6/1984 Newman
5,123,493 A 6/1992 Wenzel
5,503,228 A 4/1996 Anderson
5,647,446 A 7/1997 Wenzel
5,775,423 A 7/1998 Kaczynski
6,675,909 B1 * 1/2004 Cowart ..... E21B 31/1135 173/78
7,011,156 B2 3/2006 von Gynz-Rekowski
7,814,995 B2 10/2010 Clausen
2008/0236894 A1 * 10/2008 Clausen ..... E21B 31/1135 175/57
2014/0048247 A1 * 2/2014 Watson ..... E21B 19/22 166/72

* cited by examiner

*Primary Examiner* — Giovanna C Wright

(57) ABSTRACT

A hydraulic jar comprising a housing and a mandrel slidably disposed in the housing forming an annular space therebetween. In an embodiment, the hydraulic jar comprises a flow control device fixedly connected to the mandrel and disposed in the annular space to divide the annular space into a first portion and a second portion. The flow control device comprises an annular member slidably positioned about the mandrel, wherein the annular member comprises a face, an inside surface, and an outside surface, wherein the outside surface of the annular member is disposed against an inside surface of the tubular housing, wherein the outer surface of the annular member and the inside surface of the tubular housing allow fluid flow therebetween at a first flow rate, wherein the inside surface of the annular member and the retaining surface of the retaining assembly allow fluid flow therebetween at a second flow rate.

20 Claims, 4 Drawing Sheets

HYDRAULIC JAR AND A FLOW CONTROL DEVICE USABLE IN THE HYDRAULIC JAR

FIELD

The present invention pertains to a hydraulic jar, and in particular, but without limitation, to a fluid flow control device usable in a hydraulic jar.

BACKGROUND

A hydraulic jar is a mechanical tool employed in downhole applications to dislodge drilling or production equipment that has become stuck within a wellbore. Typically, the hydraulic jar is positioned in the drill string as part of the bottom hole assembly (BHA) and remains in place throughout the normal course of drilling operations.

As the name hydraulic "jar" implies, the function of this tool is to provide a jarring impact to free the drill bit, or another portion of the drill string, should it become stuck. A drilling jar generally consists of a first tubular member, typically referred to as a housing, which telescopically receives a second tubular member, typically referred to as a mandrel. The second tubular member is capable of limited axial movement within the first tubular member, referred to as a stroke. The first tubular member has an impact surface referred to as an anvil. The second tubular member has an impact surface referred to as a hammer. At the end of each stroke, the hammer and anvil are brought into a sudden and/or forceful contact to free the wedged drill bit.

A typical hydraulic jar includes the mandrel slidably disposed within the housing with a central bore therethrough. During drilling operations, a fluid, e.g., drilling mud, is delivered through the central bore to the drill bit. The upper end of mandrel is coupled to the drill pipe, while the lower end of mandrel is slidably received within housing. The lower end of housing is coupled to the remaining components of the BHA. A sealed annular chamber, containing hydraulic fluid, is disposed between mandrel and the housing. A flow restrictor is disposed within the chamber and coupled to the mandrel, separating the chamber into an upper chamber and a lower chamber. A hammer is coupled to the mandrel between the upper and lower shoulders, i.e., the upper and lower anvils, of the housing.

When a portion of the drill string becomes stuck within the wellbore, either a tension or compression load is applied to the drill string and the hydraulic jar is then fired to deliver an impact blow intended to dislodge the stuck portion or component. For example, when a component becomes stuck below the hydraulic jar, a tension load may be applied to the drill string, causing the drill string and mandrel of the hydraulic jar to be lifted relative to housing of hydraulic jar and the remainder of the BHA, which remains fixed. As the mandrel, with a flow restrictor coupled thereto, translates upward, fluid pressure in upper chamber increases, and the hydraulic fluid begins to slowly flow from the upper chamber, through the restrictor, to the lower chamber. The increased fluid pressure of upper chamber provides resistance to the applied tension load, causing the drill string to stretch and store energy, an action typically referred to as cocking. When a predetermined tension load is reached, hydraulic jar is fired to deliver an impact blow. This is accomplished by releasing the tension load being applied to the drill string and allowing the stored energy of the stretched drill string to accelerate the mandrel rapidly upward within the housing until the hammer of the mandrel impacts the shoulder of the housing. The momentum of this impact is transferred through housing and other components of the BHA to dislodge the stuck component.

Drilling jars commonly use hydraulic release mechanisms, which can be of varying designs, but usually have a primary fluid passage, which is obstructed by a flow control device positioned in a restrictive bore. The valve configuration prevents the free movement of the hammer portion until such time as the flow control device moves out of the restrictive bore. In order to effect movement of the device, hydraulic fluid slowly bleeds through a fluid bypass creating a time delay until the valve clears the primary fluid passage allowing free movement of the hammer portion of the tool. When the restrictive bore is no longer obstructed by the flow control device, the hammer can telescope unobstructedly to create the desired impact.

Hydraulic jars may be bi-directional, meaning they are capable of delivering an impact blow in both the uphole and downhole directions. Alternatively, a hydraulic jar may be uni-directional, meaning it is designed for and is capable of delivering an impact blow in either the uphole or downhole direction, but not both. One problem with the prior art hydraulic drilling jars pertains to the arrangement of moving parts, which provide an orifice to restrict the flow of hydraulic fluid during the cocking action of the hydraulic jar. More specifically, it is difficult to jar in both directions using a single flow control valve, due to problems in getting the valve to center itself properly in the restriction. For that reason, most two way hydraulic jars use two hydraulic flow control valves, one of which is inverted. These bi-directional hydraulic jars have two separate triggering mechanisms, which artificially lengthen the tool and result in an unnecessarily complex valve device.

Other known types of hydraulic drilling jars rely on predetermined clearances between a large number of relatively moving parts to control the flow of hydraulic fluid between the upper and lower chambers. These moving parts often require tight manufacturing tolerances, which are subject to frequent failure due to contamination and malfunction due to wear. The problems associated with prior art drilling jars cannot be tolerated, particularly in jars that are employed in deep hole drilling, where the reliability and operating characteristics of a downhole tool must be given special consideration as maintenance and repairs are time consuming and costly.

Therefore, there is a need for a flow control valve or a flow control device that is mechanically uncomplicated, is capable of intermittent or continuous use without malfunction, is relatively compact, and has both uni-directional and bi-directional capability.

Furthermore, there is a need for a flow control valve or a flow control device capable of withstanding the pressure and temperature conditions of a deep well operating environment.

Lastly, there is a need for a hydraulic jar, which is easily serviced and repaired.

Embodiments usable within the scope of the present disclosure meet these needs.

SUMMARY

The present disclosure is directed to a hydraulic jar usable for creating a shock in a downhole string. In an embodiment, the hydraulic jar can comprise a tubular housing, a mandrel disposed in the housing forming an annular space therebetween, and a flow control device fixedly connected to the mandrel and disposed in the annular space to divide the annular space into a first portion and a second portion. The flow control device can comprise a retaining device fixedly connected to the mandrel, wherein the retaining device comprises a first shoulder and a second shoulder to define a first surface extending longitudinally between the first shoulder and the second shoulder. The flow control device can also comprise at least one sleeve slidably positioned about the first surface between the first shoulder and the second shoulder, wherein the at least one sleeve comprises a first end, a second end, and an outer surface between the first end and the second end. The flow control device can allow a fluid to flow between the tubular housing and the at least one sleeve at a first rate of flow when the mandrel is moving in a first direction relative to the tubular housing, and can also allow a fluid to flow between the first surface and the at least one sleeve at a second rate of flow when the mandrel is moving in a second direction relative to the tubular housing. The first rate of flow can be different from the second rate of flow.

The present disclosure is further directed to a hydraulic jar, which can comprise a tubular housing having an inside surface, a tubular mandrel slidably disposed within the housing to define an annular space therebetween, a flow control device connected to an outer portion of the tubular mandrel, wherein the flow control device can be disposed in the annular space to define a first portion of the annular space on the first side of the flow control device and a second portion of the annular space on the second side of the flow control device. The flow control device can comprise a retaining assembly connected to the outer portion of the tubular mandrel, wherein the retaining assembly comprises a first shoulder and a first surface, and an annular member positioned about the first surface, wherein the annular member can be movable between a first position and a second position. In an embodiment, the annular member can comprise a face, an inside surface, and an outside surface, wherein the outside surface of the annular member can be disposed against the inside surface of the tubular housing. The flow control device can allow a fluid to flow between the outside surface of the annular member and the inside surface of the tubular housing at a first flow rate when the annular member is in the first position. The flow control device can further allow the fluid to flow between inside surface of the annular member and the first surface of the retaining assembly at a second flow rate when the annular member is in the second position.

The present disclosure is further directed to a method of controlling a hydraulic jar. In an embodiment, the method can comprise the steps of providing a tubular housing, providing a tubular mandrel slidably positioned within the housing to define an annular space therebetween and providing a flow control device connected to an outer portion of the tubular mandrel. The flow control device can be positioned in the annular space to divide the annular space into a first portion on the first side of the flow control device and a second portion on the second side of the flow control device. The flow control device can further comprise a first sleeve slidably positioned around the tubular mandrel, wherein the first sleeve can be retained in position by a retaining assembly connected to the tubular mandrel. The method can further comprise the steps of moving the mandrel in a first direction thereby causing the first sleeve to contact a first shoulder of the retaining assembly to form a fluid seal, between the first sleeve and the first shoulder of the retaining assembly, and communicating a hydraulic fluid from the first portion of the annular space to the second portion of the annular space, between the first sleeve and the tubular housing, at a first flow rate, thereby allowing the tubular mandrel to move with respect to the tubular housing at a first speed. In an embodiment, the method can comprise the steps of moving the mandrel in a second direction, thereby causing the first sleeve to move away from the first shoulder of the retaining assembly, to allow fluid flow between the first sleeve and the tubular mandrel and communicating a hydraulic fluid from the second portion of the annular space to the first portion of the annular space, between the first sleeve and the tubular mandrel, at a second flow rate, thereby allowing the tubular mandrel to move with respect to the tubular housing at a second speed.

The foregoing is intended to give a general idea of the invention, and is not intended to fully define nor limit the invention. The invention will be more fully understood and better appreciated by reference to the following description and drawings.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
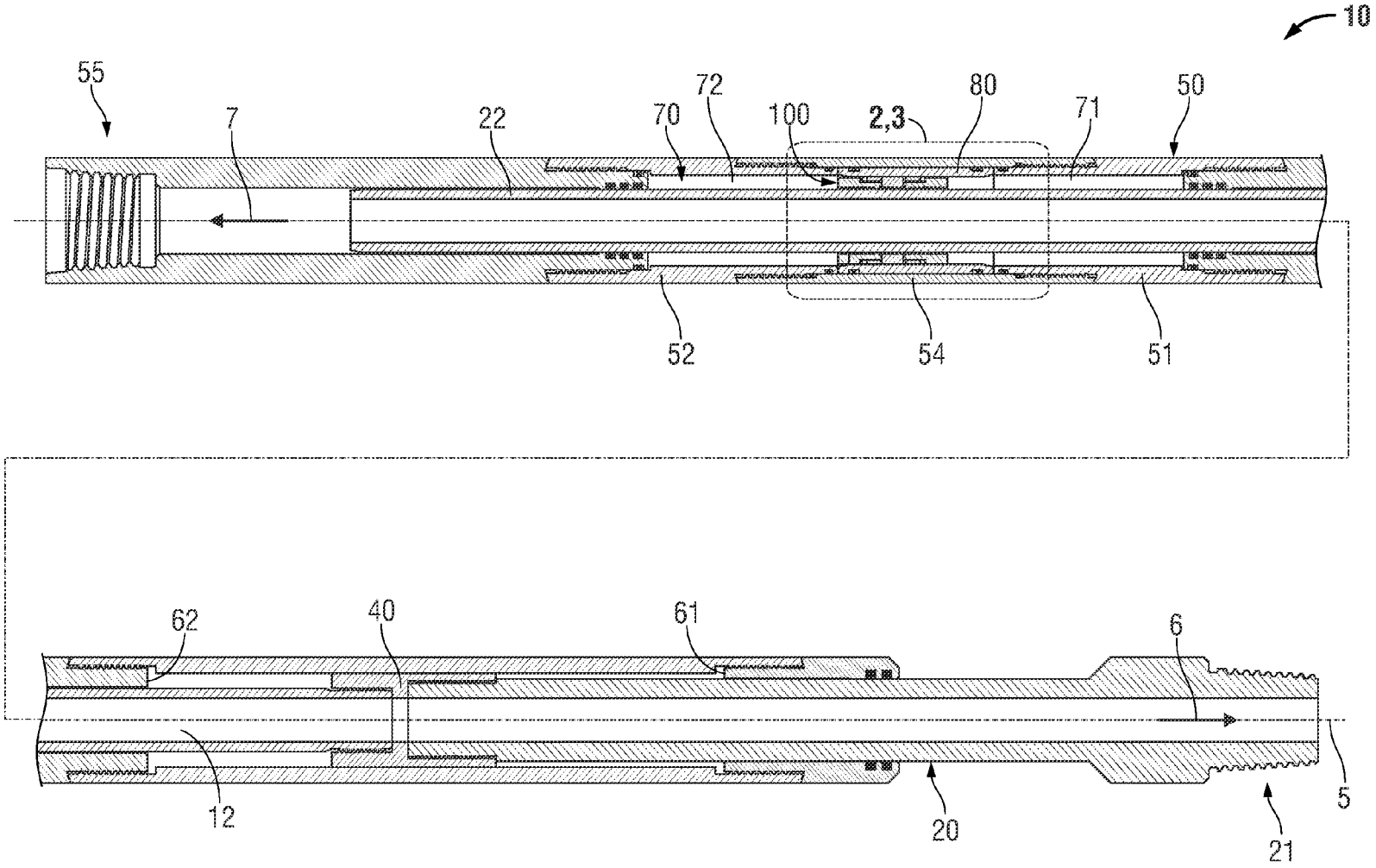
FIG. 1 depicts a cross-sectional view of an embodiment of a hydraulic jar in accordance with the present disclosure.

Referring now to FIG. 1, a hydraulic jar (10) with a flow control device (100) (i.e., a fluid metering device) is shown. The hydraulic jar (10) comprises a mandrel (20) slidably disposed within a housing (50), with a central bore (12) extending therethrough. The upper end (21) of the mandrel (20) can be coupled to the drill pipe (not shown), while the lower end (22) of mandrel (20) is slidably received within the housing (50). The lower end (55) of housing (50) can be coupled to the remaining components of the BHA (not shown). During normal drilling operations, fluid (e.g., drilling mud) is delivered through central bore (12) to the drilling bit (not shown). A sealed, annular chamber (70), containing hydraulic fluid, can be disposed between the mandrel (20) and the housing (50). The flow control device (100) can be disposed within the chamber (70) and coupled to the mandrel (20), separating the chamber (70) into an upper chamber (71) and a lower chamber (72). A hammer (40) can be coupled to the mandrel (20), between upper and lower shoulders (61, 62) of the housing (50). The flow control device (100) is shown positioned within a constriction cylinder (80) portion of the housing (50). The constriction cylinder (80) is maintained as part of the housing (80) between an upper housing portion (51), a lower housing portion (52), and a central housing portion (54).

The depicted hydraulic jar (10) is bidirectional, meaning it may deliver an impact blow, as previously described, in either an uphole direction (6) or a downhole direction (7). Thus, a tension load can be applied to the hydraulic jar (10), or more specifically, to the uphole end (21) of the mandrel (20), which moves in the uphole direction (6) relative to housing (50). Alternatively, a compression load can be applied to the uphole end (21) of the mandrel (20), which then moves in the downhole direction (7) relative to housing (50).

Figure 2:
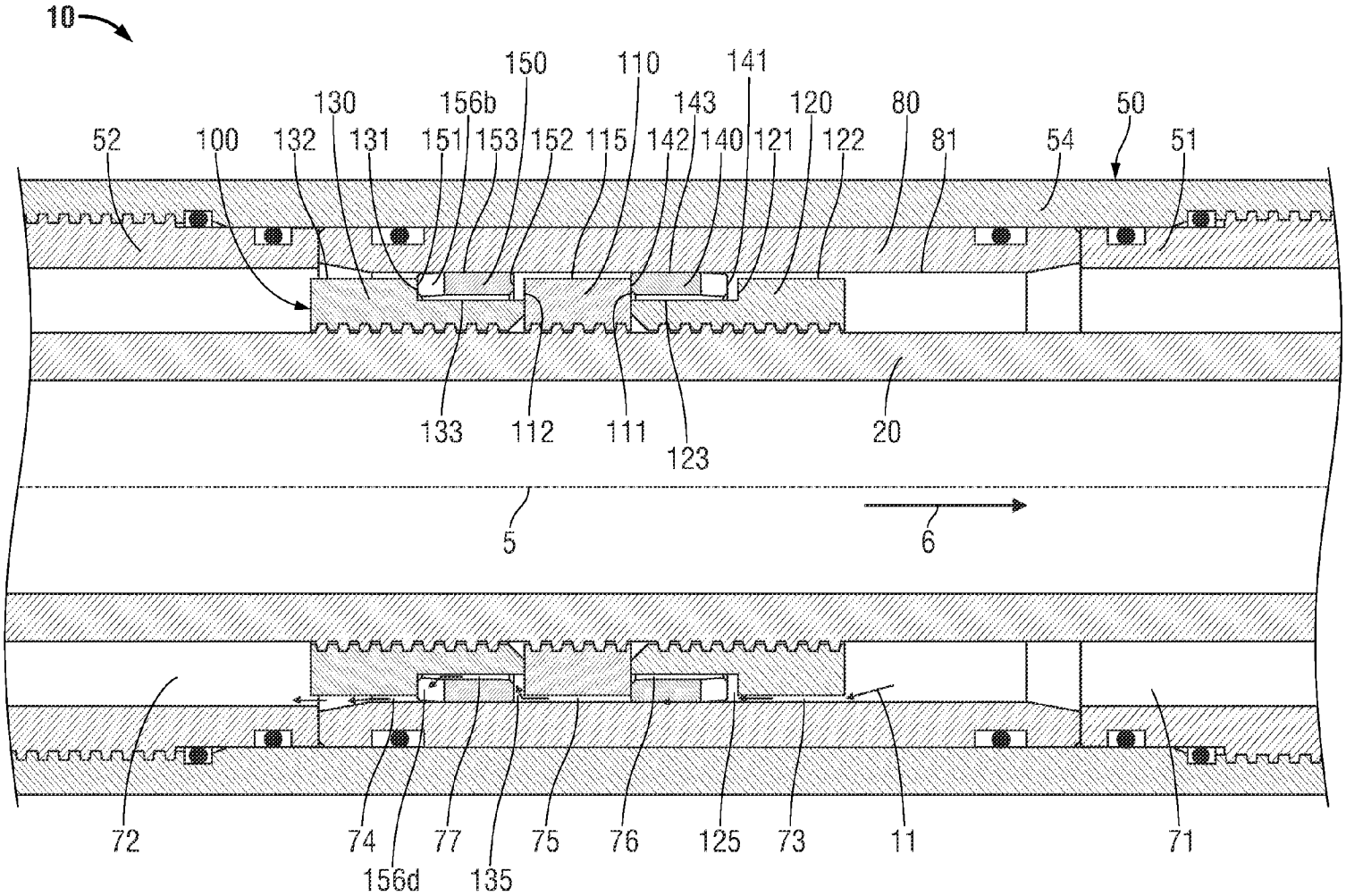
FIG. 2 depicts a close-up cross-sectional view of the hydraulic jar depicted in FIG. 1.

Referring now to FIG. 2, showing a close-up cross-sectional view of the hydraulic jar in accordance with the present disclosure. The flow control device (100) shown is configured to meter hydraulic fluid moving between the upper chamber (71) and the lower chamber (72) when the hydraulic jar (10) is in tension or compression. Specifically, the flow control device (100) obstructs, or slows down, hydraulic fluid flow between the upper chamber (71) and the lower chamber (72). Therefore, the flow control device (100) can prevent the free movement of the hammer (40) until such time as the flow control device (100) moves out of a restrictive bore section, which is depicted as a constriction cylinder (80). The constriction cylinder (80) is depicted having an inner surface (81) with a narrower, or a constricted, inside diameter in relation to the housing portions (51, 52) of the housing (50).

In order to allow movement of the mandrel (20), hydraulic fluid slowly flows (i.e., meters) between the flow control device (100) and the constriction cylinder (80), thus creating a time delay until the flow control device (100) moves past the constriction cylinder (80). At that time, the annular area, between the flow control device (100) and the housing (50), opens up and allows free movement of the mandrel (20) and the hammer (40) portions of the hydraulic jar (10) through the housing (50).

Referring again to FIG. 2, the flow control device (100) comprises a stop ring (110) threadably engaged about the mandrel (20). The stop ring (110), which functions as a retaining ring, includes upper and lower ends defining an upper shoulder (111), a lower shoulder (112), and an outer surface (115) extending therebetween. A small centrally located gap (75) (i.e., an annular space) is formed/maintained between the outer surface (115) and the inside surface (81) of the constriction cylinder (80). As described in additional detail below, during jarring operations, the shoulders (111, 112) can function as sealing surfaces, which form a fluid seal with the upper and lower metering sleeves (140, 150). In an embodiment of the flow control device (100), the shoulders (111, 112) can comprise a smooth finish, which enables the shoulders (111, 112) to form a metal-to-metal seal when compressed against the metering sleeves (140, 150) during jarring operation. In another embodiment (not shown), the shoulders (111, 112) and/or the sleeves (140, 150) can comprise sealing elements, such as O-rings or cup seals, as an additional fluid sealing means.

The flow control device (100) is further shown in FIG. 2 comprising an upper retaining ring (120) and a lower retaining ring (130) threadably engaged about the mandrel (20). The upper retaining ring (120) can have a portion having a larger diameter, defining an outer surface (122), and a portion having a smaller diameter, defining an inner surface (123). The retaining rings (120, 130), along with the stop ring, which is another retaining ring, form a retaining assembly, which is adapted to retain the metering sleeves (140, 150) in position as part of the flow control device (100). A gap (73) (i.e., an annular space) can be formed and/or maintained between the outer surface (122) and the inside surface (81) of the constriction cylinder (80). Extending radially, between the outer surface (122) and the inner surface (123), can be a transition surface that defines a shoulder (121). The lower retainer ring (130) is shown having a portion with a larger diameter, defining an outer surface (132), and a portion with a smaller diameter, defining an inner surface (133). A small gap can be retained between the outer surface (122) and the inside surface of the constriction cylinder (80). A gap (74) (i.e., an annular space) can be formed and/or maintained between the outer surface (132) and the inside surface (81) of the constriction cylinder (80). Extending radially between the outer surface (132) and the inner surface (122) can be a transition surface, which defines a shoulder (131).

Although the stop ring (110) is coupled to the mandrel with threads, it should be understood that in an alternate embodiment (not shown) of the hydraulic jar, the stop ring (110) can be integrally formed with the mandrel (20) or fixedly coupled thereto by any means know in the art, including, but not limited to, adhesives and retaining pins (not shown). Furthermore, the retaining rings (120, 130) can be retained in position by any other means known in the art, including, but not limited to, adhesives, retaining pins, and additional retaining rings (not shown), which are adapted to retain the retaining rings (120, 130) against the stop ring (110). In addition, although FIG. 2 depicts the mandrel (20), the stop ring (110) and the retaining rings (120, 130) having acme threads, any thread form having a generally straight (i.e. parallel) thread configuration may be used, including trapezoidal, square, V-shaped, or buttress thread forms, or any other thread form that allows the stop ring (110) to be positioned at a predetermined location along the mandrel (20) and the retaining rings (120, 130) on each side of the stop ring (110). The threads must have the structural integrity to withstand stresses generated during jarring operations.

Figure 4:
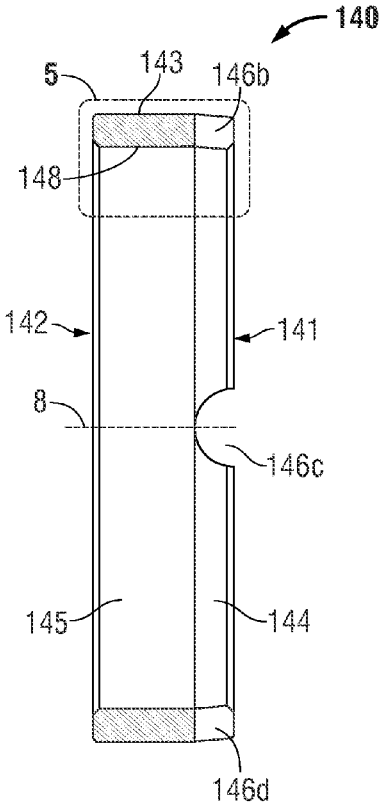
FIG. 4 depicts a cross-sectional view of an embodiment of a metering sleeve in accordance with the present disclosure.
Figure 5:
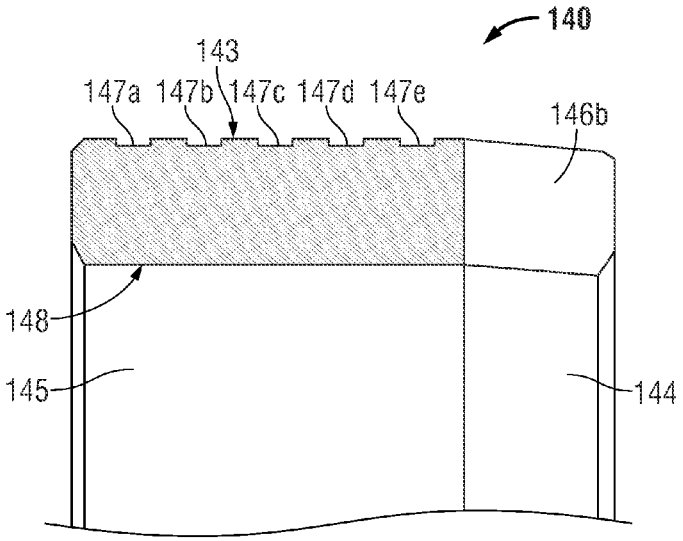
FIG. 5 depicts a close-up cross-sectional view of the metering sleeve depicted in FIG. 4.
Figure 6:
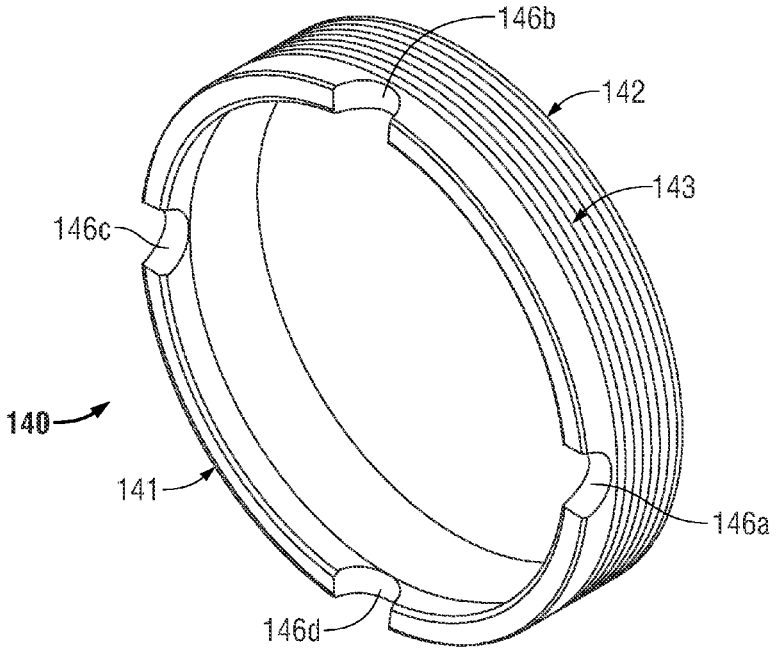
FIG. 6 depicts an isometric view of the metering sleeve depicted in FIG. 4.

FIG. 2 further depicts the flow control device (100) comprising two retaining rings (120, 130) and two metering sleeves (140, 150). The metering sleeves (140, 150) are depicted as ring shaped annular members positioned between the housing (50) and the mandrel (20). The upper metering sleeve (140) is shown positioned about the inner surface (123) of the upper retaining ring (120) and a lower metering sleeve (150) is shown positioned about the inner surface (133) of the lower retaining ring (120). Referring now to FIGS. 4 and 5, depicting close-up cross-sectional views of the upper metering sleeve (140), and FIG. 6, depicting an isometric view of the upper metering sleeve (140), in accordance with the present disclosure. The upper metering sleeve (140) is shown comprising a cylindrical portion (145), having an essentially straight throughbore defined by an essentially straight inside surface (148), and a truncated conical portion (144) having a converging (i.e., inwardly tapered) throughbore. The first end (e.g., face, edge, rim) of the upper metering sleeve (140), referred to as the sealing end (142), comprises a surface forming a fluid seal against the upper shoulder (111) of the stop ring. The sealing end (142) can comprise a smooth finish to form a metal-to-metal fluid seal when compressed against the upper shoulder (111). In another embodiment (not shown), the sealing end (142) can comprise sealing elements, such as O-rings or cup seals, as an additional fluid sealing means. The second end (e.g., face, edge, rim) of the upper metering sleeve (140), referred to as the bypass end (141), is shown comprising four radial grooves (146*a-d*) (i.e., flow channels) extending radially through the truncated conical portion (144) of the upper metering sleeve (140). The outer surface of the upper metering sleeve (140), referred to as the metering surface (143), is shown comprising five grooves (147*a-e*) (i.e., channels) extending circumferentially about the metering surface (143).

Although FIG. 6, shows the upper metering ring (140) comprising four radial grooves (146*a-c*) and FIG. 5 shows five circumferential grooves (147*a-e*), it should be understood that in another embodiment (not shown) of the hydraulic jar (10), the metering sleeve (140) can comprise any number of radial and/or circumferential grooves, which can be selected based on flow, pressure, timing delay, and other controlling operational variables. In another embodiment (not shown), the metering surface can be smooth, lacking grooves, channels, or other deformations thereon. In another embodiment (not shown) of the hydraulic jar (10), the upper and/or lower metering rings (140, 150) can have metering surfaces (143, 153) comprising other means for metering flow. For example, the metering surfaces (143, 153) can comprise grooves or channels having different widths, depths, shapes, orientations, or combinations thereof. Embodiments can also comprise grooves having diagonal or parallel orientation with respect to the central axis (8). Embodiments can also comprise grooves and/or cavities having shapes that allow for fluid metering as the fluid flows between the metering surfaces (143, 153) during jarring operations. In yet another embodiment (not shown), the inside surface (81) of the constriction cylinder (80) can be adapted for metering flow, comprising grooves or channels as described above. In still another embodiment (not shown) of the hydraulic jar (10), the outer diameter of the sleeves (140, 150) can be slightly smaller than the diameter of the inside surface (81) of the constriction cylinder (80), for forming a small gap, therebetween, and allowing faster bleeding (e.g., fluid flow). In still another embodiment (not shown) of the hydraulic jar (10), the upper retaining ring (120) may contain grooves, cavities, or channels therethrough or adjacent to the shoulder (142) to allow fluid flow between gap (76) and gap (73), which are described below, in conjunction to or instead of the radial grooves (146*a-d*) in the upper metering sleeve.

Although the above description, relating to FIGS. 4, 5, and 6, discusses the upper metering sleeve (140), it should be understood that the lower metering sleeve (150), depicted in FIG. 2, can include the same or a substantially similar configuration as the upper metering sleeve (140). Specifically, the lower metering sleeve (150) can have the same or similar parts as those of the upper metering sleeve (140), which was described above and depicted in FIGS. 4, 5, and 6. The lower metering sleeve shown in FIG. 2, includes a metering surface (153), a bypass end (151), a sealing end (152), and the radial groove (156*d*). Furthermore, the lower metering sleeve (150) can function in the same or a similar fashion as the upper metering sleeve (140).

Referring again to FIG. 2, the upper metering sleeve (140) is shown slidably positioned about the inner surface (123) of the upper retaining ring (120). The inner diameter of the cylindrical portion (145, see FIG. 4) of the upper metering sleeve (140) can be larger than the diameter of the inner surface (123) of the upper retaining ring (120), forming a gap (76) (i.e., an annular space) therebetween. Because the truncated conical portion (144, see FIG. 4) converges toward the inner surface (123), the truncated conical portion (144) can retain the upper metering sleeve (140) in an essentially central position about the upper retaining ring (120), resulting in an essentially equal gap (76) around the entire inner surface (123) of the upper retaining ring (120). As further shown in FIG. 2, the upper metering sleeve (140) is shown being retained in a longitudinal position by the shoulder (121) of the upper retaining ring (120) and the upper shoulder (111) of the stop ring (110). The inner surface (123) of the upper retaining ring (120) can be wider than the upper metering sleeve (140), resulting in a gap (125) (i.e., an annular space) formed between the shoulder (121) and the bypass end (141) of the upper metering sleeve (140).

Figure 3:
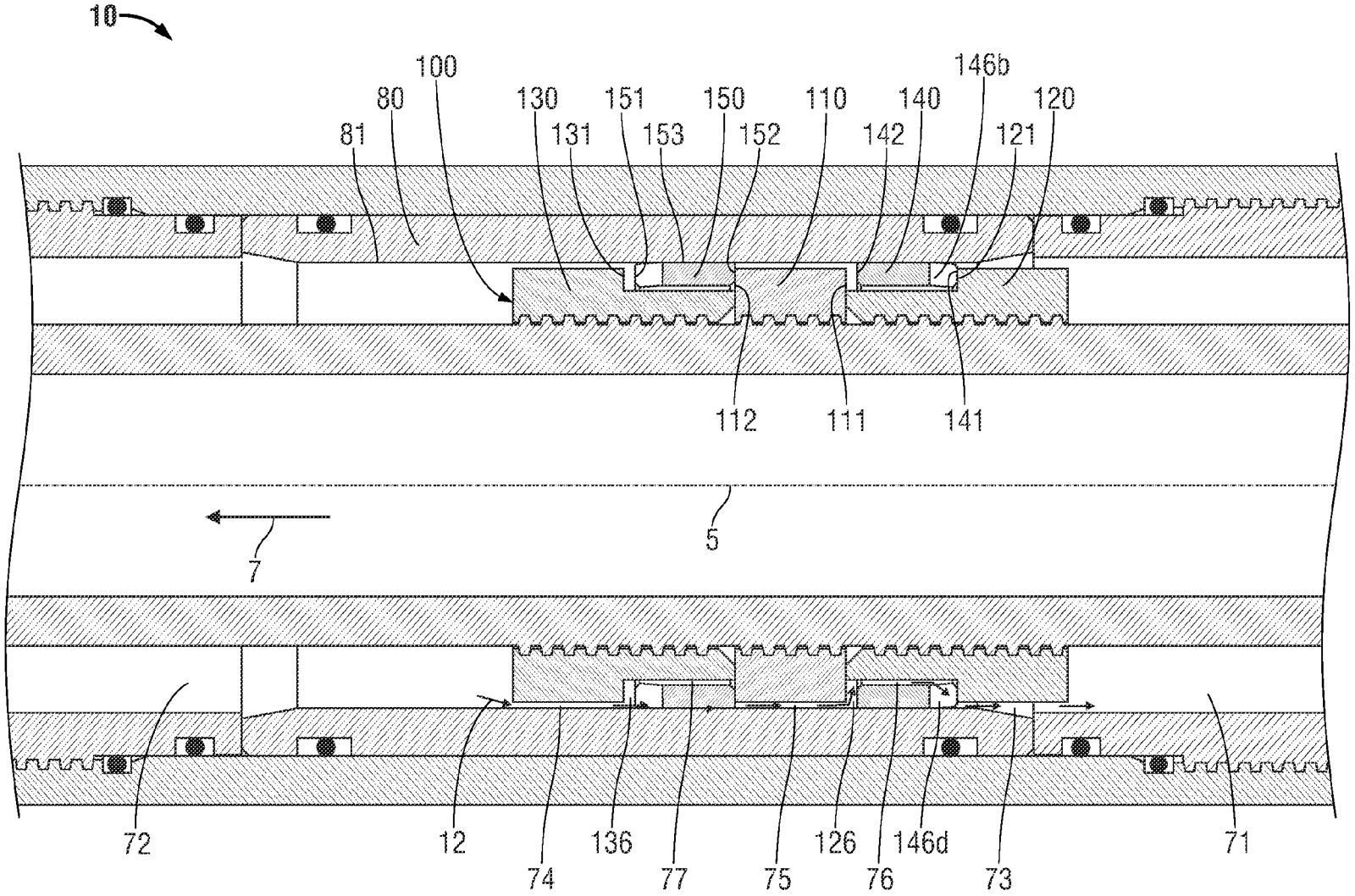
FIG. 3 depicts a close-up close sectional view of the hydraulic jar depicted in FIG. 1.

The slidable upper metering sleeve (140) can move in either the uphole direction (6) or the downhole direction (7), which allows the upper metering sleeve (140) to be positioned against the upper shoulder (111), as shown in FIG. 2. The upper metering sleeve (140) can be moved against the shoulder (121) of the upper retaining ring (120) to form a gap (126) (i.e., a space) between the upper metering sleeve (140) and the upper shoulder (111) of the stop ring retaining ring, as shown in FIG. 3. The gap (126) is shown connecting gap (76) with gap (75), allowing fluid communication therebetween.

Referring again to FIG. 2, the lower metering sleeve (150) is shown positioned about the inner surface (133) of the lower retaining ring (130). Similarly to the upper metering sleeve (140), the inner diameter of the cylindrical portion of the lower metering sleeve (150) can be larger than the diameter of the inner surface (133) of the lower retaining ring (130), forming an gap (77) (i.e., an annular space) therebetween. Because the truncated conical portion converges toward the inner surface (133), the truncated conical portion retains the lower metering sleeve (150) in an essentially central position about the lower retaining ring (130), resulting in an essentially equal gap (77) around the entire inner surface (133) of the lower retaining ring (130). As further shown in FIG. 2, the lower metering sleeve (150) is shown retained in a longitudinal position by the shoulder (131) of the lower retaining ring (130) and the lower shoulder (112) of the stop ring (110). The inner surface (133) of the lower retaining ring (130) can be wider than the lower metering sleeve (150), resulting in a gap (135) (i.e., an annular space) formed between the lower shoulder (112) and the sealing end (152) of the lower metering sleeve (150). The gap (135) is shown connecting gap (77) with gap (75), allowing fluid communication therebetween.

Similarly to the upper metering sleeve (140), the lower metering sleeve (150) can be slidable about the inner surface (133) of the lower retaining ring (130). The lower metering sleeve (150) can move in either the uphole direction (6) or the downhole direction (7), which allows the lower metering sleeve (150) to be positioned against the shoulder (131), as shown in FIG. 2. The lower metering sleeve (150) can be moved against the lower shoulder (112) of the stop ring (110) to form the gap (136) (i.e., a space) between the lower metering sleeve (150) and the shoulder (131) of the lower retaining ring, as shown in FIG. 3.

Referring again to FIG. 1, depicting an embodiment of the hydraulic jar (10) in accordance with the present disclosure. During normal drilling operations, flow control device (100) is positioned downhole (7) of the constriction cylinder (80) of the housing and not in engagement with the constriction cylinder (80). When a component of the drill string (not shown) becomes stuck and it is desired to deliver an impact blow to the drill string in the uphole direction (6), a tension load may be applied to a retracted hydraulic jar (100), as previously described.

As previously stated and depicted in FIG. 2, the constriction cylinder (80) comprises an inside surface (81) having a smaller inside diameter than the inner surface of the upper and lower housing portions (51, 52). As the flow control device (100) enters the constriction cylinder (80), a fluid restriction is formed between the inside surface (81) and the metering surfaces (143, 153) of the flow control device (100). Thus, when aligned with the constriction cylinder (80), the metering sleeves (140, 150) of the flow control device (100) engage the inside surface (81) of the constriction cylinder (80), resulting in flow restriction or metering action, as the hydraulic fluid flows between the upper portion (71) and the lower portion (72) of the annular chamber (70).

Referring also to FIG. 1, a tension load may be applied to the upper end (21) of the mandrel (20). In response, the mandrel (20) begins to move within the housing (50) in the uphole direction (6), along the central axis (5) extending longitudinally along the hydraulic jar (10), bringing the fluid control device (100) within the constriction cylinder (80). As a result of the alignment between the flow control device (100) and the constriction cylinder (80), fluid pressure in upper chamber (71) begins to increase. In turn, the increase in fluid pressure in the upper chamber (71) and/or the friction between the metering surfaces (143, 153) and the inside surface (81) of the constriction cylinder (80), causes the upper and the lower metering sleeves (140, 150) to contact the stop ring (110) and the lower retaining ring (130) respectively. Specifically, the sealing end (142) of the upper metering sleeve (140) contacts the upper shoulder (111) of the stop ring (110), and the bypass end (153) of the lower metering sleeve contacts the shoulder (131) of the lower retaining ring (130).

Hydraulic fluid then begins to flow through the flow control device (100). Specifically, as indicated by the arrows (11), the hydraulic fluid flows from upper chamber (71) into the gaps (73, 125). Thereafter, the hydraulic fluid flows between the metering surface (143) of the upper metering sleeve (140) and the inside surface (81) of the constriction cylinder (80), thus metering (e.g., restricting, reducing) hydraulic fluid flow by the reduced flow area therebetween. The hydraulic fluid cannot bypass the upper metering sleeve (140) through gap (76), as the sealing end (142) is forced against the upper shoulder (111) to form a metal-to-metal fluid seal therebetween. Once the hydraulic fluid passes the upper metering sleeve (140), the fluid enters the gap (75) and continues to flow through the gap (135) into the gap (77). Thereafter, the hydraulic fluid flows through the radial grooves (156*a-d*, 156*a* and 156*c* not shown), bypassing the lower metering sleeve (150), and continues into the gap (74) and the lower chamber (72). Thus, hydraulic fluid is metered as it passes from the upper chamber (71) to the lower chamber (72), slowing down the movement of the mandrel (20) within the housing (50).

When a predetermined time delay is reached, and a tension load that is believed sufficient or necessary to free the stuck tool is reached, the hydraulic jar (100) can be fired to deliver an impact blow. Specifically, as mandrel (20) continues to move slowly in the uphole direction (6) under tension, the drill string (not shown) stretches elastically and stores mechanical energy therein. When the flow control device (100) exits the constriction cylinder (80), the flow path between the upper chamber (71) and the lower chamber (72) is opened, as the fluid flow is no longer metered by the upper metering sleeve (140), thereby allowing hydraulic fluid to pass into the lower chamber (72) at a substantially higher flow rate. At that moment, the drill string is allowed to contract, accelerating the mandrel (20) and, thus, the hammer (40), in the uphole direction (6) until the hammer impacts the upper shoulder (61) of the housing (50) to create an impact to free the stuck tool. Moreover, the higher the load applied to the mandrel (20), which can be proportional to the time delay, the faster the acceleration of the mandrel (20) and the greater the impact force delivered to the housing (50).

In a similar manner, when a component of the drill string becomes stuck and it is desired to deliver an impact blow to the drill string in the downhole direction (7), a compression load may be applied to an extended hydraulic jar (100).

Referring now to FIGS. 1 and 3, a compression load may be applied to the upper end (21) of the mandrel (20). In response, the mandrel (20) can begin to move axially downhole (7) within the housing (50), bringing the fluid control device (100) within the constriction cylinder (80). As a result of the alignment of the flow control device (100) with the constriction cylinder (80), fluid pressure in lower chamber (72) begins to increase. In turn, the increase in fluid pressure in the lower chamber (72), and/or the friction between the metering surfaces (143, 153) and the inside surface (81) of the constriction cylinder (80), causes the upper and the lower metering sleeves (140, 150) to contact the upper retaining ring (120) and the stop ring (110), respectively. Specifically, the bypass end (141) of the upper metering sleeve (140) contacts the shoulder (121) of the upper retaining ring (120) and the sealing end (152) of the lower metering sleeve (150) contacts the lower shoulder (112) of the stop ring (110).

Hydraulic fluid then begins to flow through the flow control device (100). Specifically, as indicated by the arrows (12), the hydraulic fluid flows from the lower chamber (72) into gap (74) and gap (136). Thereafter, the hydraulic fluid flows between the metering surface (153) of the lower metering sleeve (150) and the inside surface (81) of the constriction cylinder, thus metering (e.g., restricting, reducing) hydraulic fluid flow by the reduced flow area therebetween. The hydraulic fluid cannot bypass the lower metering sleeve (150) through gap (77), as the sealing end (152) is forced against the lower shoulder (112) to form a metal-to-metal fluid seal therebetween.

Once the hydraulic fluid passes the lower metering sleeve (150), the fluid enters the gap (75) and continues to flow through the gap (126) into the gap (76). Thereafter, the hydraulic fluid flows through the radial grooves (146*a-d*, 146*a* and 146*c* shown in FIG. 6), bypassing the upper metering sleeve (140), and continues into the gap (73) and the upper chamber (72). Thus, hydraulic fluid is metered as it passes from the lower chamber (72) to the upper chamber (71), slowing down the movement of the mandrel (20) within the housing (50).

When a predetermined time delay is reached, and a compression load that is believed sufficient or necessary to free the stuck tool is reached, the hydraulic jar (100) is fired to deliver an impact blow. Specifically, as mandrel (20) continues to move slowly in the downhole direction (7) under compression, the drill string (not shown) compresses elastically and stores mechanical energy therein. When the flow control device (100) exits the constriction cylinder (80), the flow path between the lower chamber (72) and the upper chamber (71) is opened significantly, as the fluid flow is no longer metered by the lower metering sleeve (150), allowing hydraulic fluid to pass into the upper chamber (71) at a substantially higher flow rate. At that moment, the drill string is allowed to expand, accelerating the mandrel (20) and, thus, the hammer (40), in the downhole direction (7), until the hammer (40) impacts the lower shoulder (62) of the housing (50) to create an impact to free the stuck tool. Moreover, the higher the load applied to the mandrel (20), which can be proportional to the time delay, the faster the acceleration of the mandrel (20) and the greater the impact force delivered to the housing (50).

As described above, the flow control device (100) depicted in FIGS. 2 and 3, is bidirectional, meaning it provides hydraulic fluid metering when the hydraulic jar (100) is actuated via either tension or compression. It should be understood that the manner in which the flow control device (100) meters fluid when the hydraulic jar (100) is in tension can be similar or the same to the manner in which the flow control device (100) meters fluid when the hydraulic jar (100) is in compression.

It should also be understood that in another embodiment (not shown) of the hydraulic jar (10), the flow control device (100) can be constructed or reconfigured to be uni-directional, acting to provide fluid metering when the hydraulic jar (100) is under either tension or compression, but not both. To reconfigure the flow control device (100) to provide fluid metering only when hydraulic jar (100) is in tension, the lower metering sleeve (150) can be configured in the opposite direction about the inner surface (133) of the lower retaining ring (130), wherein the bypass end (151) is positioned uphole (6) relative to the sealing end (152). In another embodiment (not shown) of the hydraulic jar (10), the lower metering sleeve (150) and the lower retaining ring (130) can be decoupled from the mandrel (20) and removed from the flow control device (100). The above configurations will allow fluid metering as the mandrel (20) is moving in the uphole direction (6), while allowing the fluid to bypass the metering sleeves (140, 150) as the mandrel (20) moves in the downhole direction (7) relative to the housing (20).

Similarly, in another embodiment (not shown) of the hydraulic jar (10), to reconfigure the flow control device (100) to provide fluid metering only when hydraulic jar (100) is in compression, the upper metering sleeve (140) can be configured in the opposite direction about the inner surface (123) of the upper retaining ring (120), wherein the bypass end (141) is positioned downhole (7) relative to the sealing end (142). In yet another embodiment (not shown) of the hydraulic jar (10), the upper metering sleeve (140) and the upper retaining ring (120) can be decoupled from the mandrel (20) and removed from the flow control device (100). These configurations will allow fluid metering as the mandrel (20) is moving in the downhole direction (7), while allowing the fluid to bypass the metering sleeves (140, 150), as the mandrel (20) is moving in the uphole direction (6) relative to the housing (20).

While various embodiments usable within the scope of the present disclosure have been described with emphasis, it should be understood that within the scope of the appended claims, the present invention can be practiced other than as specifically described herein. It should be understood by persons of ordinary skill in the art that an embodiment of the hydraulic jar (10) and the flow control device (100) in accordance with the present disclosure can comprise all of the features described above. However, it should also be understood that each feature described above can be incorporated into the hydraulic jar (10) and the flow control device (100) by itself or in combinations, without departing from the scope of the present disclosure.

What is claimed is:

1. A hydraulic jar usable for creating a shock in a downhole string, the hydraulic jar comprising:

a tubular housing;

a mandrel disposed in the housing forming an annular space therebetween; and a flow control device fixedly connected to the mandrel and disposed in the annular space to divide the annular space into a first portion and a second portion, wherein the flow control device comprises:

a retaining device fixedly connected to the mandrel, wherein the retaining device comprises a first shoulder and a second shoulder to define a first surface extending longitudinally between the first shoulder and the second shoulder; and at least one sleeve slidably positioned about the first surface between the first shoulder and the second shoulder, wherein the at least one sleeve comprises a first end, a second end, and an outer surface between the first end and the second end, wherein the flow control device allows a fluid to flow between the tubular housing and the at least one sleeve at a first rate of flow when the mandrel is moving in a first direction relative to the tubular housing, wherein the first end of the at least one sleeve forms a fluid seal against the first shoulder when the mandrel is moving in the first direction, and wherein the flow control device allows a fluid to flow between the first surface and the at least one sleeve at a second rate of flow when the mandrel is moving in a second direction relative to the tubular housing, wherein the first rate of flow is different from the second rate of flow.

2. The hydraulic jar of claim 1, wherein the tubular housing comprises a reduced diameter portion adapted to engage the at least one sleeve.

3. The hydraulic jar of claim 1, wherein the outer surface of the at least one sleeve comprises a feature for metering fluid flow.

4. The hydraulic jar of claim 1, wherein the outer surface of the at least one sleeve comprises a plurality of grooves.

5. The hydraulic jar of claim 1, wherein the at least one sleeve or the retaining device comprises at least one fluid pathway therein to allow fluid to flow between the at least one sleeve and the first surface.

6. The hydraulic jar of claim 1, wherein the fluid seal causes the fluid to flow between the tubular housing and the at least one sleeve.

7. The hydraulic jar of claim 1, wherein the retaining device comprises a first retaining ring having the first shoulder and a second retaining ring having a third shoulder.

8. The hydraulic jar of claim 1, wherein the retaining device further comprises a third shoulder and a fourth shoulder to define a second surface extending longitudinally between the third shoulder and the fourth shoulder, wherein the flow control device further comprises a second sleeve, wherein the second sleeve is slidably positioned about the second surface between the third shoulder and the fourth shoulder, wherein the second sleeve comprises a first end, a second end, and an outer surface between the first end and the second end, wherein the flow control device allows the fluid to flow between the tubular housing and the second sleeve at a third rate of flow when the mandrel is moving in a second direction relative to the tubular housing, and wherein the flow control device allows a fluid to flow between the second surface and the at least one sleeve at a fourth rate of flow when the mandrel is moving in a first direction relative to the tubular housing.

9. A hydraulic jar comprising:

a tubular housing having an inside surface;

a tubular mandrel slidably disposed within the housing to define an annular space therebetween;

a flow control device connected to an outer portion of the tubular mandrel, wherein the flow control device is disposed in the annular space to define a first portion of the annular space on the first side of the flow control device and a second portion of the annular space on the second side of the flow control device, wherein the flow control device comprises:

a retaining assembly connected to the outer portion of the tubular mandrel, wherein the retaining assembly comprises a first shoulder and a first surface; and an annular member positioned about the first surface, wherein the annular member is movable between a first position and a second position, wherein the annular member comprises a face, an inside surface, an outside surface, and at least one fluid pathway allowing fluid to flow between the annular member and the retaining assembly, wherein the outside surface of the annular member is disposed against the inside surface of the tubular housing, wherein the flow control device allows a fluid to flow between outside surface of the annular member and the inside surface of the tubular housing at a first flow rate when the annular member is in the first position, wherein the face forms a fluid seal against the shoulder, and wherein the flow control device allows the fluid to flow between inside surface of the annular member and the first surface of the retaining assembly at a second flow rate when the annular member is in the second position.

10. The hydraulic jar of claim 9, wherein the tubular housing comprises a reduced diameter portion adapted to receive the flow control device.

11. The hydraulic jar of claim 9, wherein the inside surface of the annular member and the first surface of the retaining assembly define an annular space therebetween.

12. The hydraulic jar of claim 9, wherein the outside surface of the annular member, the inside surface of the tubular housing, or combinations thereof comprises a feature for controlling the rate of fluid flow.

13. The hydraulic jar of claim 9, wherein the outside surface of the annular member, the inside surface of the tubular housing, or combinations thereof comprises a plurality of grooves for controlling the rate of fluid flow.

14. The hydraulic jar of claim 9, further comprising:

a second retaining assembly connected to the outer portion of the tubular mandrel, wherein the second retaining assembly comprises a second shoulder and a second surface; and a second annular member positioned about the second surface, wherein the second annular member is movable between a first position and a second position, wherein the second annular member comprises a face, an inside surface, and an outside surface, wherein the outside surface of the second annular member is disposed against the inside surface of the tubular housing, wherein the flow control device allows a fluid to flow between outside surface of the second annular member and the inside surface of the tubular housing at a third flow rate when the second annular member is in the first position, and wherein the flow control device allows the fluid to flow between inside surface of the second annular member and the first surface of the second retaining assembly at a fourth flow rate when the second annular member is in the second position.

15. A method of controlling a hydraulic jar, the method comprising the steps of:

providing a tubular housing;

providing a tubular mandrel slidably positioned within the housing to define an annular space therebetween;

providing a flow control device connected to an outer portion of the tubular mandrel, wherein the flow control device is positioned in the annular space to divide the annular space into a first portion on the first side of the flow control device and a second portion on the second side of the flow control device, wherein the flow control device comprises a first sleeve slidably positioned around the tubular mandrel, and wherein the first sleeve is retained in position by a retaining assembly connected to the tubular mandrel;

moving the mandrel in a first direction thereby causing the first sleeve to contact a first shoulder of the retaining assembly to form a fluid seal between the first sleeve and the first shoulder of the retaining assembly;

communicating a hydraulic fluid from the first portion of the annular space to the second portion of the annular space between the first sleeve and the tubular housing at a first flow rate thereby allowing the tubular mandrel to move with respect to the tubular housing at a first speed;

moving the mandrel in a second direction thereby causing the first sleeve to move away from the first shoulder of the retaining assembly to allow fluid flow between the first sleeve and the tubular mandrel; and communicating a hydraulic fluid from the second portion of the annular space to the first portion of the annular space between the first sleeve and the tubular mandrel at a second flow rate thereby allowing the tubular mandrel to move with respect to the tubular housing at a second speed.

16. The method of claim 15, wherein the retaining assembly further comprises a second shoulder, wherein the step of moving the mandrel in the second direction comprises moving the mandrel in the second direction thereby causing the sleeve to contact the second shoulder of the retaining assembly to break the fluid seal to allow fluid flow between the first sleeve and the tubular mandrel.

17. The method of claim 15, wherein an outside surface of the first sleeve, an inside surface of the tubular housing, or combinations thereof are adapted to control the rate of fluid flow therebetween.

18. The method of claim 15, the method further comprising:

providing the flow control device further comprising a second sleeve slidably positioned around the tubular mandrel, wherein the second sleeve is retained in position by the retaining assembly connected to the tubular mandrel;

moving the mandrel in a first direction thereby causing the second sleeve to move away from the second shoulder of the retaining assembly to allow fluid flow between the second sleeve and the tubular mandrel; and moving the mandrel in a second direction thereby causing the second sleeve to contact the second shoulder of the retaining assembly to form a fluid seal between the first sleeve and the second shoulder of the retaining assembly.

19. A hydraulic jar usable for creating a shock in a downhole string, the hydraulic jar comprising:

a tubular housing;

a mandrel disposed in the housing forming an annular space therebetween; and a flow control device fixedly connected to the mandrel and disposed in the annular space to divide the annular space into a first portion and a second portion, wherein the flow control device comprises:

a retaining device fixedly connected to the mandrel, wherein the retaining device comprises a first shoulder and a second shoulder to define a first surface extending longitudinally between the first shoulder and the second shoulder; and at least one sleeve slidably positioned about the first surface between the first shoulder and the second shoulder, wherein the at least one sleeve comprises a first end, a second end, and an outer surface comprising a plurality of grooves and located between the first end and the second end, wherein the flow control device allows a fluid to flow between the tubular housing and the at least one sleeve at a first rate of flow when the mandrel is moving in a first direction relative to the tubular housing, and wherein the flow control device allows a fluid to flow between the first surface and the at least one sleeve at a second rate of flow when the mandrel is moving in a second direction relative to the tubular housing, wherein the first rate of flow is different from the second rate of flow.

20. A hydraulic jar comprising:

a tubular housing having an inside surface;

a tubular mandrel slidably disposed within the housing to define an annular space therebetween;

a flow control device connected to an outer portion of the tubular mandrel, wherein the flow control device is disposed in the annular space to define a first portion of the annular space on the first side of the flow control device and a second portion of the annular space on the second side of the flow control device, wherein the flow control device comprises:

a retaining assembly connected to the outer portion of the tubular mandrel, wherein the retaining assembly comprises a first shoulder and a first surface; and an annular member positioned about the first surface, wherein the annular member is movable between a first position and a second position, wherein the annular member comprises a face, an inside surface, and an outside surface, wherein the outside surface of the annular member is disposed against the inside surface of the tubular housing, wherein the flow control device allows a fluid to flow between outside surface of the annular member and the inside surface of the tubular housing at a first flow rate when the annular member is in the first position, and wherein the flow control device allows the fluid to flow between inside surface of the annular member and the first surface of the retaining assembly at a second flow rate when the annular member is in the second position, wherein the outside surface of the annular member, the inside surface of the tubular housing, or combinations thereof comprises a plurality of grooves for controlling the rate of fluid flow.

* * * * *